US005511788A

United States Patent [19]

Manley et al.

[11] Patent Number: 5,511,788

[45] Date of Patent: Apr. 30, 1996

[54] GOLF WRIST TRAINING APPARATUS

[76] Inventors: Michael P. Manley, 1090 Oakwood, Ortonville, Mich. 48462; William Corder, 1206 Stonehurst Rd., Anderson, S.C. 29625; David A. Cullon, 4317 Lake George Rd., Dryden, Mich. 48428

[21] Appl. No.: 291,125

[22] Filed: Aug. 16, 1994

[51] Int. Cl.[6] ..... A63B 69/36

[52] U.S. Cl. ..... 473/213; 473/212

[58] Field of Search ..... 273/54 B, 189 R, 273/189 A, 183 B, 29 A

[56] References Cited

U.S. PATENT DOCUMENTS

| | | | |
|---|---|---|---|
| 3,606,342 | 9/1971 | Albertson, Jr. | 273/189 R |
| 4,057,255 | 11/1977 | Bishop | 273/189 |
| 4,176,840 | 12/1979 | Lanning | 273/54 B |
| 4,245,841 | 1/1981 | Owens, Jr. | 273/189 R |
| 4,660,829 | 4/1987 | Whiteneir | 273/29 A |
| 5,353,440 | 10/1994 | Meldeau | 2/161.1 |
| 5,390,928 | 3/1995 | Satini | 273/187.2 |
| 5,401,017 | 3/1995 | McDonald et al. | 273/21 C |

*Primary Examiner*—V. Millin
*Assistant Examiner*—Charles W. Anderson
*Attorney, Agent, or Firm*—Gerald R. Black

[57] ABSTRACT

A golf wrist training apparatus is attachable to the arm of the golfer-in-training, and controls the range of wrist movement during each of the various phases of a golf swing. The apparatus includes a hand-attachment member and a fore-arm-attachment member. The apparatus restricts enables the wrists to move freely in the lateral plane of motion, and restricts wrist movement within the forward/backward plane of motion. The backswing allowable range of motion is greater than the downswing allowable range of motion. The apparatus also includes a release mechanism which enables the apparatus to be easily reset prior to each use.

30 Claims, 2 Drawing Sheets

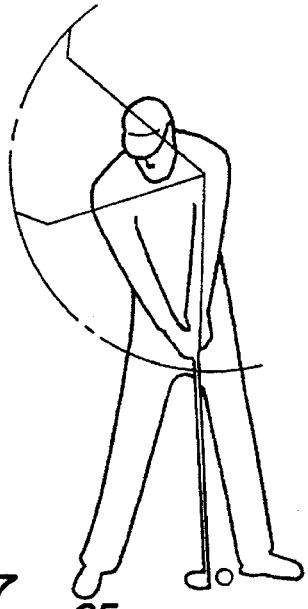
Fig - 4
Fig - 5
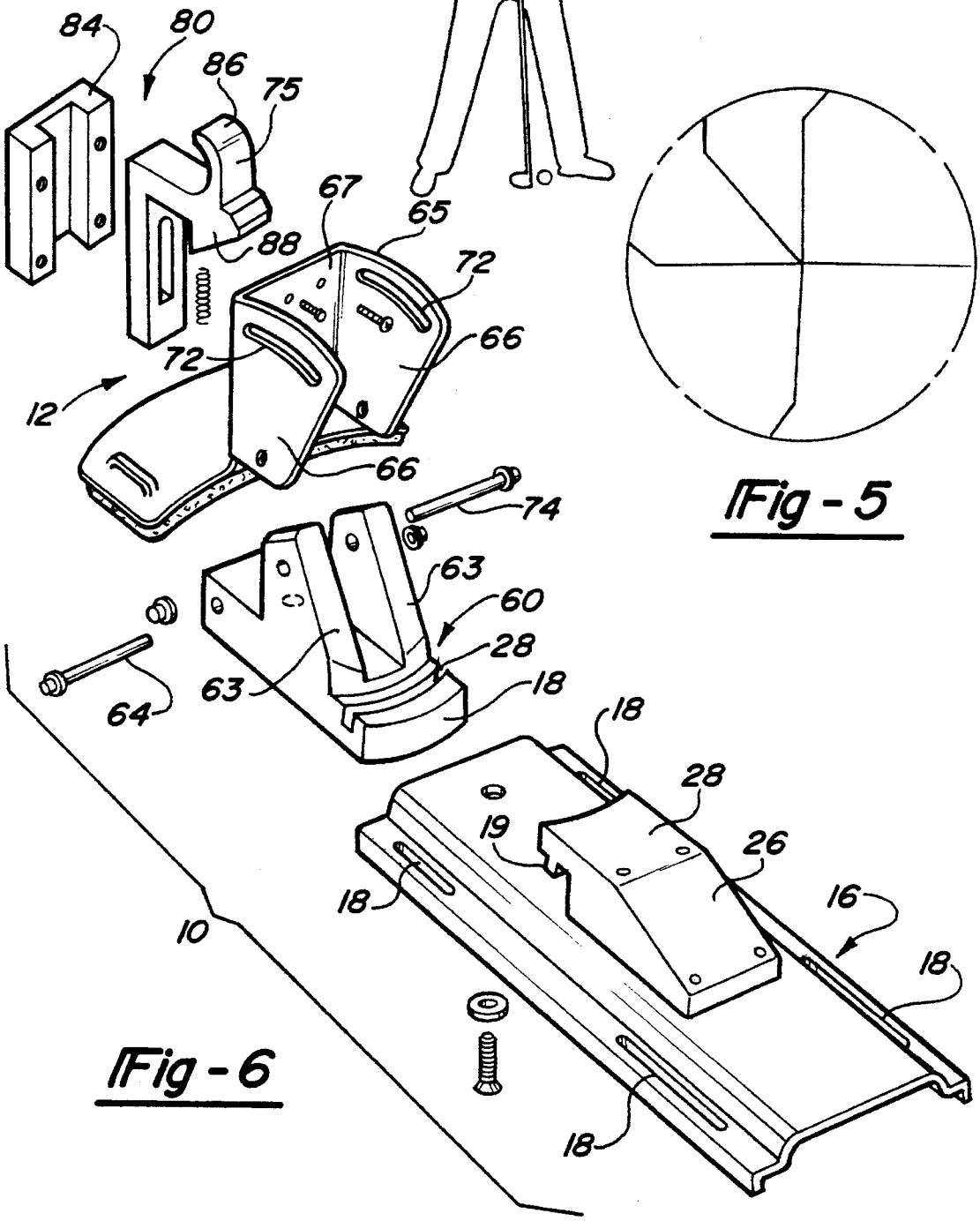
Fig - 6

GOLF WRIST TRAINING APPARATUS

BACKGROUND OF THE INVENTION

1. Field of the Invention

This invention relates to a wrist control apparatus which is designed to be worn on the arm of a golfer-in-training so as to teach such golfer to employ proper wrist movement during the entire golf swing, including the address of the ball, and during the backswing, downswing, impact, and follow-through.

2. Background Art

The correct golf swing is a set of highly complex body movements which require precise coordination of the hands, arms, shoulders, torso, hips, legs, and knees of the golfer, occurring at the proper sequence, and at the precise instant as the weight is shifted to enable optimum power delivery to the ball. The golfer can only master the golf swing if each movement becomes second nature, since it is not possible to concentrate on each individual movement during the few seconds of the golf swing.

While the motion of each part of the body is important as the golfer's body coils and then uncoils, proper wrist movement during the golf swing is particularly important as all of the power is transferred from the golfer's body through the club grip, along the club length, into the club head, and into the ball through the arms and wrists of the golfer. It is, therefore, critical that the wrists of the golfer be properly positioned to assure that the club-head is "square" through impact.

U.S. Pat. No. 3,606,342 represents a design for controlling the wrist movement of an athlete, such as a golfer or bowler. While this device provides wrist control, it is not specifically designed for the mechanics of a golf swing and fails to address key elements of the swing. Since the proper wrist angle in the forward/backward plane is not throughout the swing, this device lacks any adjustability in wrist angle. Also, this device fails to take into account the difference in range of wrist movement during the backswing and the downswing.

What is needed is an apparatus that controls the angle of wrist rotation in the forward/backward plane of motion while providing no restraint in the lateral plane: which enables different amounts of rotation in the forward/backward plane of motion during the backswing and the downswing to within acceptable prescribed limits, and is adjustable so as to adapt to different golf swings involving different clubs.

SUMMARY OF THE INVENTION

It is the object of the present invention to enable the golfer-in-training to maintain the proper wrist positioning in both the forward/backward plane and the lateral plane throughout the swing, including the backswing, at the top of the backswing, the downswing, and at impact.

It is another object of the present invention to enable the wrists of the golfer-in-training to move freely into a gully cocked position at the top of the backswing, and then to prevent the golfer-in-training from breaking such wrists in the forward/backward plane beyond a predetermined limit during the downswing and at impact.

It is still another object of the present invention to enable the golfer-in-training the option of releasing the holding mechanism after each swing, thereby enabling such golfer to move his wrists freely in the forward/backward plane during the backswing and lock his wrists during the downswing and at impact.

It is another object of the present invention to provide adjustability in the range of motion for the wrists in the forward/backward plane so that the golfer-in-training can effectively adjust the maximum angle that the wrists can bend.

It is another object of the present invention to alert the golfer-in-training that the wrists have been "set" during the backswing at the proper angle in the forward/backward plane.

The apparatus of the present invention is designed to control the wrists of the golfer-in-training, as the apparatus is worn preferably upon the following hand/forearm of a golfer-in-training. The following hand/forearm as used herein is the right hand/forearm for a right-handed golfer, and the left hand/forearm for a left-handed golfer. However, with minor modifications one skilled in the art can modify the teaching of the present invention so that the apparatus can be worn on the leading hand/forearm of the golfer-in-training, or even a pair of devices can be worn on each arm of the golfer-in-training.

The golf wrist training apparatus of the present invention controls the range of wrist movement during backswing, downswing, impact, and follow-through in both the lateral and the forward/backward planes of motion. The apparatus enables full movement of the following hand within a range of motion in the lateral plane throughout the golf swing both prior to engagement and after engagement.

Both the hand-attachment member and the forearm-attachment member are preferably secured to the following arm of the golfer-in-training.

The apparatus also restricts movement of the hand-attachment member relative to the forearm-attachment member within a backswing preset range of motion in a forward/backward plane prior to engagement. The restraint mechanism restricts movement of the hand-attachment member relative to the forearm-attachment member within a downswing range of motion in the forward/backward plane during the downswing after engagement. The allowable range of motion during the downswing in the forward/backward plane is preferably much more restrictive than the allowable range of motion during the backswing.

The apparatus also includes a release mechanism which enables the golfer-in-training the option of resetting the apparatus prior to each use, Also, a distinct clicking sound during the backswing alerts the golfer-in-training that the apparatus is engaged.

For a more complete understanding of the golf wrist training apparatus of the present invention, reference is made to the following detailed description and accompanying drawings in which the presently preferred embodiment of the invention is shown by way of example. As the invention may be embodied in several forms without departing from the spirit or essential characteristics thereof, it is expressly understood that the drawings are for purposes of illustration and description only, and are not intended as a definition of the limits of the invention. Throughout the description and drawings, like reference numbers refer to the same component throughout the several views.

BRIEF DESCRIPTION OF THE DRAWINGS

FIG. 4 shows a golfer-in-training addressing a golf ball wearing the golf wrist training apparatus of the present invention of FIG. 1, the backswing arc being shown in phantom;

FIG. 5 shows the arc of the downswing and follow-through in phantom for the golfer-in-training shown in FIG. 4; and FIG. 6 is a detailed assembly view of the preferred embodiment of the golf wrist training apparatus of FIG. 1.

DETAILED DESCRIPTION OF THE INVENTION

A detailed assembly view of the preferred embodiment of the golf wrist training apparatus [10] is shown in FIG. 6 and includes a forearm-attachment member [16], a hand-attachment member [12], quadrant [60], and a latch/release mechanism [80].

Figure 1:
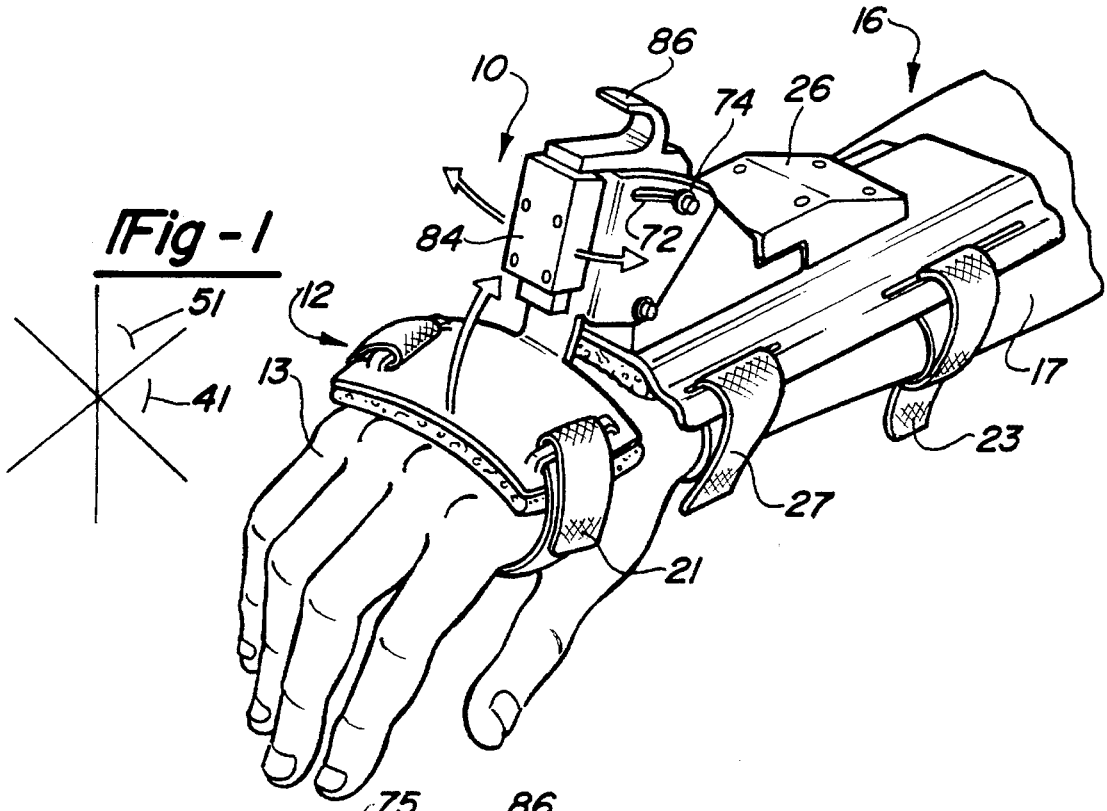
FIG. 1 is a simplified perspective view of the preferred embodiment of the golf wrist training apparatus of the present invention, relative to the lateral and the forward/backward planes of motion.

The movement of the wrists of the golfer-in-training are controlled within a predetermined range by strapping the golf wrist training apparatus [10] of the present invention to his following arm. The golf wrist training apparatus [10] includes a hand-attachment member [12] which is attachable to the hand [13], and a forearm-attachment member [16] which is the longer of the two members and is attachable to the forearm [17] of the golfer-in-training (see FIG. 1). Preferably the attachment means is a plurality of straps, having hook and loop type fasteners (Velcro®) and being laced between a pair of slotted openings [18] disposed at opposing ends and integral with members [12 and 16], although other types of straps may be used. A hand strap [21] is attached to the hand-attachment member [12], and two forearm straps [22 and 23] are attached to the forearm-attachment member [16].

Figure 2:
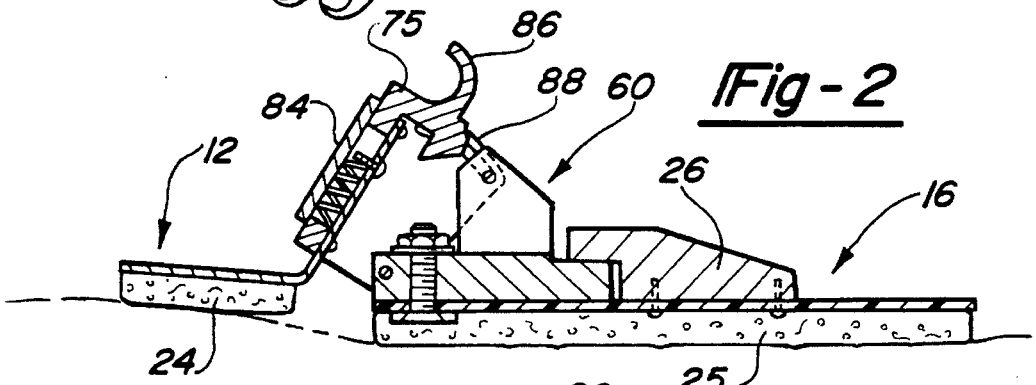
FIG. 2 is an exploded sectional side view of the golf wrist training apparatus of FIG. 1 prior to engagement.
Figure 3:
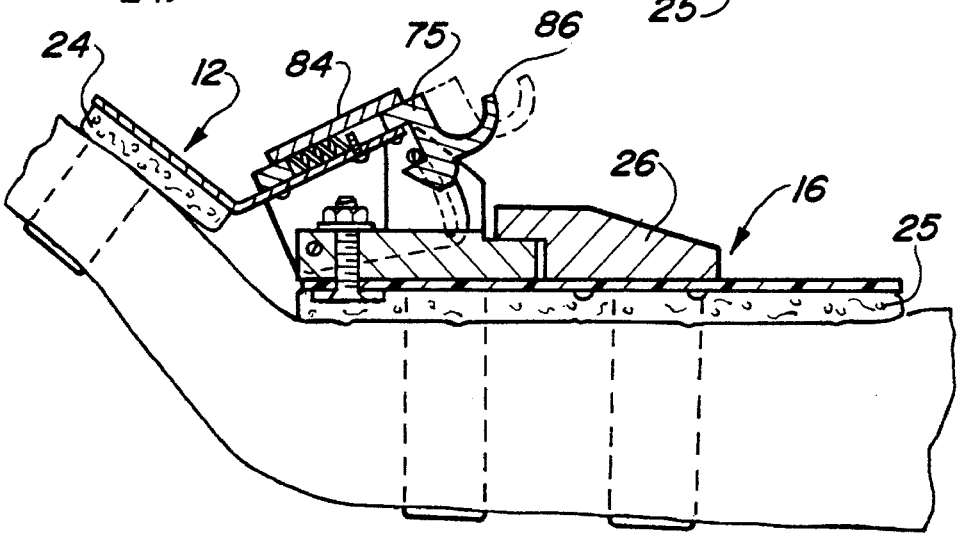
FIG. 3 is an exploded sectional side view of the golf wrist training apparatus of FIG. 1 after engagement.

FIG. 2 shows a side view of the apparatus [10] prior to engagement (the angle of the wrist relative to a line extending through the forearm being less than 5°), and FIG. 3 shows a side view after engagement. The hand-attachment member [12] and the forearm-attachment member [16] are joined by the quadrant [60]. The quadrant [60] enables movement of the hand-attachment member [12] relative to the forearm-attachment member [16] in both the forward/backward plane of motion [51] and the lateral plane of motion [41], the two planes being essentially perpendicular to each other.

A keeper [26] or mounting bracket is securely mounted onto the forearm attachment member [16]. The quadrant [60] is also attached to the forearm-attachment member [16] and is pinned in such a manner as to enable full 360° rotation relative to the forearm-attachment member [16] and the keeper [26]. An arcuate extension [18] of the keeper [26] engages a flange [28] of the quadrant[60]. In addition, a curved protrusion [19] on the lip [18] of the keeper [26] cooperatively engages with a curved recess in the flange [28] of the quadrant [60] to prevent buckling of the apparatus [10] during use.

A pair of opposing extensions [63] sloping towards the forearm-attachment member [16] extend from the quadrant [60]. The top of the each extension [63] includes an opening [68] for receiving a cylindrical engagement bar [74]. The quadrant [60] cooperates with a squared flange [65] to enable engagement and subsequent disengagement, as shown in FIGS. 2 and 3.

The squared flange [65] extends upward and away from the hand-attachment portion [12]. The squared flange [65] includes opposing surfaces [66] joined together by an adjoining surface [67]. A pivot pin [64] extends through the base of the opposing surfaces [66] and the base of the quadrant [60] enabling rotation of the squared flange [65].

A pair of opposing extensions [63] sloping towards the forearm-attachment member [16] protrude away from the quadrant [60]. The top of the each extension [63] includes an opening [68] for receiving a cylindrical engagement bar [74].

An engagement bar [74] is a cylindrical pin [74] capped at both ends slides within the arcuate grooves [72], enabling rotation in the forward/backward plane [51] of the hand-attachment member [12] relative to the forearm-attachment member [16]. The engagement bar [74] is mounted at the top of and extends through the opposing extensions [63] of the quadrant [60] and through identical arcuate grooves [72] of the opposing surfaces [66].

The total angle of the arcuate grooves [72] within the opposing surfaces [66] determines the amount of allowable relative motion between the hand-attachment member [12] and the forearm-attachment member [16] in the forward/backward plane [51].

Initially, the quadrant [60] enables the wrist of the golfer-in-training to be cocked backward relative to the forearm from 0° to 10° as the club head is aligned next to the ball.

The angle which is formed by the wrist of the following arm in the backswing is largely maintained during the downswing as the club head approaches the ball—the angle then straightens out slightly in the impact zone.

After the golfer-in-training has completed his swing, it is necessary to release the golf wrist training apparatus [10] in the forward/backward plane [51] so that the golfer-in-training may comfortably address and hit the next ball. This is accomplished by means of a spring-loaded latch [75] that cooperates with the capped engagement bar [74] that is retained within two matching slotted members [85].

The latch [75] catches the engagement bar [74] and enables the pin [75] to open as the following wrist of the golfer-in-training sets during the backswing. The latch [75] cooperating with the engagement bar [74] enable the wrists of the golfer-in-training to cock rearwardly during the backswing.

During engagement, the engagement bar [74] is positioned at the extreme of the arcuate grooves [72] nearest the adjoining surface [67] as the angle between the hand-attachment member [12] and the forearm attachment member [16] is maximum. Prior to engagement the engagement bar [74] slides within the arcuate grooves. Once the engagement bar [74] catches the latch [75], engagement occurs.

The apparatus [10] also includes a release mechanism [80] which enables disengagement in the forward/backward plane [51] enabling the apparatus [10] to be reset after each use. The release mechanism [80] includes the spring-loaded latch [75] and a slotted member [84] which receives and provides a track for the latch [75] as the latch [75] slides therethrough enabling engagement. The extreme top of the latch [75] includes a hook-shaped portion [86] and a ramp [88]. The ramp [88] cooperates with the capped engagement bar [74] during the backswing, and when the wrist of the golfer-in-training is set backward as much as 85°, the latch [75] catches the engagement bar [74] locking into place becoming engaged. The apparatus [10] thereby regulates the angular rotation of the hand-attachment member [12] relative to the forearm-attachment member [16] in the forward/backward plane [51].

The apparatus [10] also enables full movement or the following wrist in the lateral plane [41] during all phases of the golf swing both prior to engagement and after engagement.

The apparatus [10] is preferably made of a hard, lightweight plastic, an injected plastic polymer, perhaps even reinforced with fiberglass to withstand the high forces, and a thick layer of spongy plastic [24 and 25] is disposed between the hand-attachment member [12] and the hand and the forearm-attachment member and the forearm [16] and the forearm for comfort.

The allowable range of wrist motion in the forward/backward plane [51] during the backswing is preferably greater than the range of motion in the forward/backward plane [51] during the downswing. The quadrant [60] enables the wrist angle of the following arm to increase as the club is taken away from the ball during the backswing and reaches a certain maximum of anywhere from 20° to 85°, and preferably from 35° to 45° relative to the forearm at the top of the backswing (see FIGS. 4 and 5). This wide amount of variance takes into account the differences in golf swings, and also the difference in opinions of various golf instructors.

During the downswing, however, the proper wrist angle again decreases to between 15° and 30° at impact, approaches 0° halfway through the follow-through and finishes at about a 30° angle. The apparatus [10] allows the golfer-in-training to move his wrist to approach 0° but never through that angle.

Adjustability is necessary to enable the golfer-in-training to properly stroke the wide variety of shots (driving, chipping, putting) that are necessary in a routine round of golf. Varying the maximum angle that the wrists can bend in the forward/backward plane [51] can be accomplished in either of two ways:

(1) loosening the hand strap [21] enables the wrist of the golfer-in-training to move in the forward/backward plane [51] with greater flexibility than if the hand strap [21] is tightly bound to the hand [13]; or (2) adjusting the latch mechanism will either increase or decrease the range of motion in the forward/backward plane [51] of motion.

This adjustibilty feature may also be used to set the angle of engagement, and to use the apparatus during the backswing and the downswing fully engaged. Since the swing of each golfer, and the swing for each of the various clubs differs somewhat, for some golfers-in-training it may be useful to have the same allowable range wrist movement in the forward/backward plane during the backswing and during the downswing, and not to have a range of motion during the backswing that is different than the range of motion during the downswing. Hence, for these golfers once the proper angle is set, the release mechanism is not reset after each swing.

The apparatus [10] alerts the golfer-in-training of engagement, or that the wrists have been "set" during the backswing in the proper angle in the forward/backward plane [51]. The golfer-in-training is able to move his wrists freely in the lateral plane [41] even if his wrists are not properly set in the forward/backward plane [51].

The hands of the golfer travelling in the forward/backward plane [51] may exceed speeds of 100 mph during the downswing and at impact. Accordingly, it is necessary to restrain the wrist at an angle greater than the ideal angle and position through the impact zone. For example, if it is determined that the following wrist ideally is to restrained at an angle of 10° at impact, it might be necessary to restrain the wrist at a 45° angle. The resulting force caused by the rapidly accelerating wrists will cause the following hand to separate to some extent from the fixed restraining mechanism.

While the golf training apparatus [10] of the present invention has been described in conjunction with attachment onto the following arm of the golfer-in-training, it will be evident to one skilled in the art that the apparatus can be readily adapted to fit onto the leading arm of the golfer-in-training. Since both hands of the golfer-in-training are effectively joined at the golf club grip, when the following wrist is bent backward, the leading wrist is bent forward. Accordingly, the farther back the following wrist is bent, the farther forward the leading wrist is bent. If the apparatus [10] is adapted to fit onto the leading wrist of the golfer-in-training, the mechanics of engagement work essentially in reverse as engagement occurs when the leading wrist is bent forward at the top of the backswing.

Furthermore, it is evident that many other alternatives, modifications, and variations of the apparatus of the present invention will be apparent to those skilled in the art in light of the disclosure herein. It is intended that the metes and bounds of the invention be determined by the appended claims rather than by the language of the above specification, and that all such alternatives, modifications, and variations which form a functional or conjointly cooperative equivalent are intended to be included within the spirit and scope of these claims.

We claim:

1. A golf training apparatus to assist in controlling wrist movement of a golfer-in-training during address, backswing, downswing, impact, and follow-through, the apparatus comprising:

(a) means to attach a hand-attachment member of the apparatus to a first hand and a forearm-attachment member of the apparatus to such forearm of the first hand of the golfer-in-training, the hand-attachment member relative to the forearm-attachment member forming an angle in a forward/backward plane, the forward/backward plane being normal to the first hand; and (b) restraint means to limit movement of the hand-attachment member relative to the forearm-attachment member within a range of motion in the forward/backward plane when the restraint means is engaged, the angle in the forward/backward plane being adjustable.

2. The golf training apparatus of claim 1, further comprising reset means to disengage the restraint means after the golfer-in-training has completed each swing.

3. The golf training apparatus of claim 2, wherein the reset means is the preferred way to disengage the restraint means.

4. The golf training apparatus of claim 1, wherein the restraint means becomes engaged when the hand-attachment member relative to the forearm-attachment member reaches a preselected angle.

5. The golf training apparatus of claim 1, wherein the restraint means becomes engaged between the top of the backswing and prior to impact.

6. The golf training apparatus of claim 1, wherein once engagement occurs, the restraint means cannot be overcome by the golfer-in-training.

7. A golf training apparatus to assist in controlling wrist movement of a golfer-in-training during address, backswing, downswing, impact, and follow-through, the apparatus comprising:

(a) means to attach a hand-attachment member of the apparatus to a first hand and a forearm-attachment member of the apparatus to such forearm of the first hand of the golfer-in-training the hand-attachment member relative to the forearm-attachment member forming an angle in a forward/backward plane, the forward/backward plane being normal to the first hand;

(b) restraint means to limit movement of the hand-attachment member relative to the forearm-attachment member within a pre-set range of motion once engagement occurs; and (c) reset means to disengage the restraint means after the golfer-in-training has completed each swing.

8. The golf training apparatus of claim 7, wherein the reset means is the preferred way to disengage the restraint means.

9. The golf training apparatus of claim 7, wherein the angle in the forward/backward plane is adjustable.

10. The golf training apparatus of claim 7, wherein the restraint means becomes engaged when the hand-attachment member relative to the forearm-attachment member reaches a preselected angle.

11. The golf training apparatus of claim 7, wherein the restraint means becomes engaged between the top of the backswing and prior to impact.

12. The golf training apparatus of claim 7, wherein once engagement occurs, the restraint means cannot be overcome by the golfer-in-training.

13. A golf training apparatus to assist in controlling wrist movement of a golfer-in-training during address, backswing, downswing, impact, and follow-through, the apparatus comprising:

(a) means to attach a hand-attachment member of the apparatus to a first hand and a forearm-attachment member of the apparatus to such forearm of the first hand of the golfer-in-training, the hand-attachment member relative to the forearm-attachment member forming an angle in a forward/backward plane, the forward/backward plane being normal to the first hand;

(b) restraint means to limit movement of the hand-attachment member relative to the forearm-attachment member within the forward/backward plane of motion, the restraint means becoming engaged between the top of the backswing and prior to impact.

14. The golf training apparatus of claim 13, further comprising reset means to disengage the restraint means after the golfer-in-training has completed each swing.

15. The golf training apparatus of claim 14, wherein the reset means is the preferred way to disengage the restraint means.

16. The golf training apparatus of claim 13, wherein the angle in the forward/backward plane is adjustable.

17. The golf training apparatus of claim 13, wherein the restraint means becomes engaged when the hand-attachment member relative to the forearm-attachment member reaches a preselected angle.

18. The golf training apparatus of claim 13, wherein once engagement occurs, the restraint means cannot be overcome by the golfer-in-training.

19. A golf training apparatus to assist in controlling wrist movement of a golfer-in-training during address, backswing, downswing, impact, and follow-through, the apparatus comprising:

(a) means to attach a hand-attachment member of the apparatus to a first hand and a forearm-attachment member of the apparatus to such forearm of the first hand of the golfer-in-training, the hand-attachment member relative to the forearm-attachment member forming an angle in a forward/backward plane, the forward/backward plane being normal to the first hand; and (b) restraint means to limit movement of the hand-attachment member relative to the forearm-attachment member in the forward/backward plane of motion, the restraint means becoming engaged when the hand-attachment member relative to the forearm-attachment member reaches a preselected angle.

20. The golf training apparatus of claim 19, further comprising reset means to disengage the restraint means after the golfer-in-training has completed each swing.

21. The golf training apparatus of claim 20, wherein the reset means is the preferred way to disengage the restraint means.

22. The golf training apparatus of claim 19, wherein the angle in the forward/backward plane is adjustable.

23. The golf training apparatus of claim 19, wherein the restraint means becomes engaged between the top of the backswing and prior to impact.

24. The golf training apparatus of claim 19, wherein once engagement occurs, the restraint means cannot be overcome by the golfer-in-training.

25. A golf training apparatus to assist in controlling wrist movement of a golfer-in-training during address, backswing, downswing, impact, and follow-through, the apparatus comprising:

(a) means to attach a hand-attachment member of the apparatus to a first hand and a forearm-attachment member of the apparatus to such forearm of the first hand of the golfer-in-training, the hand-attachment member relative to the forearm-attachment member forming an angle in a forward/backward plane, the forward/backward plane being normal to the first hand; and (b) restraint means to limit movement of the hand-attachment member relative to the forearm-attachment member within a range of motion in the forward/backward plane when the restraint means is engaged;

wherein once engagement occurs, the restraint means cannot be overcome by the golfer-in-training.

26. The golf training apparatus of claim 25, further comprising reset means to disengage the restraint means after the golfer-in-training has completed each swing.

27. The golf training apparatus of claim 26, wherein the reset means is the preferred way to disengage the restraint means.

28. The golf training apparatus of claim 25, wherein the restraint means becomes engaged when the hand-attachment member relative to the forearm-attachment member reaches a preselected angle.

29. The golf training apparatus of claim 25, wherein the restraint means becomes engaged between the top of the backswing and prior to impact.

30. The golf training apparatus of claim 25, wherein the restraint the angle in the forward/backward plane is adjustable.

* * * * *